US011844482B2

(12) United States Patent
Zhang et al.

(10) Patent No.: US 11,844,482 B2
(45) Date of Patent: Dec. 19, 2023

(54) CLEANING DEVICE

(71) Applicant: SHENZHEN JASHEN TECHNOLOGY CO., LTD., Shenzhen (CN)

(72) Inventors: Xiao-Ming Zhang, Shenzhen (CN); Yan-Cheng He, Shenzhen (CN)

(73) Assignee: SHENZHEN JASHEN TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/407,563

(22) Filed: Aug. 20, 2021

(65) Prior Publication Data

US 2022/0304528 A1 Sep. 29, 2022

(30) Foreign Application Priority Data

Mar. 27, 2021 (CN) ..... 202110328952.6

(51) Int. Cl.
*A47L 7/00* (2006.01)

(52) U.S. Cl.
CPC ..... *A47L 7/0009* (2013.01); *A47L 7/0014* (2013.01); *A47L 7/0023* (2013.01); *A47L 7/0042* (2013.01)

(58) Field of Classification Search
CPC .... A47L 7/0009; A47L 7/0014; A47L 7/0023; A47L 7/0042; A47L 11/4016; A47L 11/4041; A47L 11/4044; A47L 11/4083; A47L 11/4088; A47L 11/282; A47L 11/302; A47L 11/40; A47L 11/4069
See application file for complete search history.

(56) References Cited

U.S. PATENT DOCUMENTS

| | | | | |
|---|---|---|---|---|
| 10,136,781 | B2 * | 11/2018 | Li | A47L 11/4041 |
| 11,540,689 | B2 * | 1/2023 | Johnson | A47L 11/4061 |
| 2015/0082579 | A1 * | 3/2015 | Lin | A47L 1/02 15/320 |
| 2018/0310795 | A1 * | 11/2018 | Li | A47L 11/4027 |
| 2018/0338660 | A1 * | 11/2018 | Li | A47L 11/302 |
| 2019/0246860 | A1 * | 8/2019 | Li | A47L 11/4088 |

FOREIGN PATENT DOCUMENTS

| | | | | |
|---|---|---|---|---|
| CN | 113040637 | * | 6/2021 | A47L 11/40 |
| WO | WO2020228516 | A1 * | 11/2020 | A47L 11/4088 |
| WO | WO2021233827 | A1 * | 6/2021 | A47L 11/34 |

* cited by examiner

*Primary Examiner* — David Redding
(74) *Attorney, Agent, or Firm* — Muncy, Geissler, Olds & Lowe

(57) ABSTRACT

A cleaning device includes a host, a drag head assembly and a water spray assembly. The host includes a housing, a control device housed in the housing and a handle member fixedly connected to the housing. The housing contains a water inlet pipe for connecting to a water source. The drag head assembly is fixed on the housing and electrically connected to the control device. The control device is used to control the drag head assembly for cleaning operations. The drag head assembly includes a cleaning brush head. The water spray assembly is fixed in the drag head assembly and connected to the end of the water inlet pipe away from the water source. The water spray assembly has evenly set spray holes. The direction of the spray holes is towards the cleaning brush head.

8 Claims, 14 Drawing Sheets

CLEANING DEVICE

BACKGROUND OF THE INVENTION

1. Field of the Invention

The present invention relates to the cleaning equipment technology field, in particular to a cleaning device.

2. Description of the Related Art

With the advancement of science and technology and the improvement of living standards, various technologies to improve human labor efficiency have emerged, and cleaning devices for ground cleaning are one of them.

In most cleaning operations, in order to effectively clean the surface of the object, it is usually necessary to wet the surface of the object to be cleaned with water, so that the surface of the object can be dissolved in water and transferred to the cleaning device. However, cleaning devices on the market generally need to be equipped with a humidifying device to moisten the cleaning device. A small number of cleaning devices equipped with a wetting device have a poor wetting effect on the cleaning device, resulting in insufficient wetting of the cleaning device. Finally, the result of the partial cleaning area water or the partial cleaning surface cleaning effect is not ideal, which brings great inconvenience to the majority of consumers.

SUMMARY OF THE INVENTION

In view of the shortcomings of the prior art, the purpose of the present invention is to provide a cleaning device, which is equipped with an independent water spray assembly, so that the cleaning device can achieve uniform water spray and continuous water spray during the cleaning process, which is beneficial to improve the cleaning effect of the cleaning device and improve cleaning efficiency.

In order to achieve the above purpose, the present invention provides the following technical solutions: a cleaning device, comprising a host, a drag head assembly and a water spray assembly. The host comprises a housing, a control device housed in the housing, and a handle member fixedly connected to the housing. The housing contains a water inlet pipe for connecting a water source. The drag head assembly comprises a cleaning brush head. The water spray assembly is fixed in the drag head assembly and communicates with the end of the water inlet pipe away from the water source. The water spray assembly comprises a plurality of spray holes evenly distributed, and the water outlet directions of the spray holes are all facing the cleaning brush head.

Preferably, the water spray assembly comprises a nozzle portion means provided with a cavity and a diversion portion fixedly connected to the nozzle portion means and in communication with the cavity. The diversion portion communicates with the end of the water inlet pipe means far away from the water source. The diversion portion diverts the water in the water source into the cavity through the water inlet pipe means and sprays the water out through the spray holes. The spray holes are set on the side of the nozzle portion means facing the cleaning brush head.

Preferably, the nozzle portion means comprises a first nozzle portion and a second nozzle portion fixedly connected to each other. The spray holes are arranged on the side of the first nozzle portion facing the cleaning brush head. The second nozzle portion is provided with at least one deflector on the side opposite to the spray holes. The at least one deflector and the diversion portion are fixedly connected and communicate with each other.

Preferably, the inner diameter of the cavity gradually increases along the spray holes toward the second nozzle portion.

Preferably, the first nozzle portion comprises a first inner side wall and a second inner side wall set relative to each other. The first inner side wall comprises a first step and a second step sequentially arranged along the spray holes toward the second nozzle portion. The distance between the first step and the second inner side wall is less than the distance between the second step and the second inner side wall.

Preferably, the diversion portion comprises a water pump connected with one end thereof to the end of the water inlet pipe means away from the water source, a three-way valve connected with one end thereof to an opposite end of the water pump, and a guide tube connected with one end thereof to an opposite end of the three-way valve. The guide tube having an opposite end thereof connected and fixed to the at least one deflector to keep the three-way valve in communication with the cavity. The water inlet pipe means comprises a first water inlet pipe arranged between the water source and the water pump, and a second water inlet pipe arranged between the water pump and the three-way valve.

Preferably, the water source is set as a water tank device that is embedded in the housing and has a water storage function, and the water tank device is in communication with the first water inlet pipe.

Preferably, the cleaning device further comprises a sewage recovery device. The sewage recovery device comprises a sewage tank embedded in the housing, a suction assembly connected to the sewage tank and set in the drag head assembly, and a sewage pipe used to connect the sewage tank and the suction assembly. The suction assembly sucks the sewage generated in the drag head assembly away from the drag head assembly and transports the sewage to the sewage tank through the sewage pipe.

Preferably, the cleaning brush head is set as a roller brush, and the roller brush is rotatably set on the drag head assembly. The sewage recovery device also comprises a scraper. The scraper is fixed on the drag head assembly and kept in contact with the roller brush.

Preferably, the drag head assembly is provided with a fixed plate. The water spray assembly is fixed on an upper part of the fixed plate. The scraper is fixed on the fixed plate and located under the water spray assembly. The suction assembly comprises a suction port opened on the fixed plate and located below the scraper. The roller brush is assembled and fixed on the side of the fixed plate where the scraper is installed and abuts against the scraper.

The present invention solves the problem of wetting of the cleaning brush head during the cleaning process by setting up the water spray assembly in the cleaning device and spraying water to the cleaning brush head. The evenly set spray holes ensure that the surface of the cleaning brush head can be wetted more evenly, which is beneficial to improve the cleaning effect of the cleaning device and improve the cleaning efficiency.

DETAILED DESCRIPTION OF THE INVENTION

Figure 1:
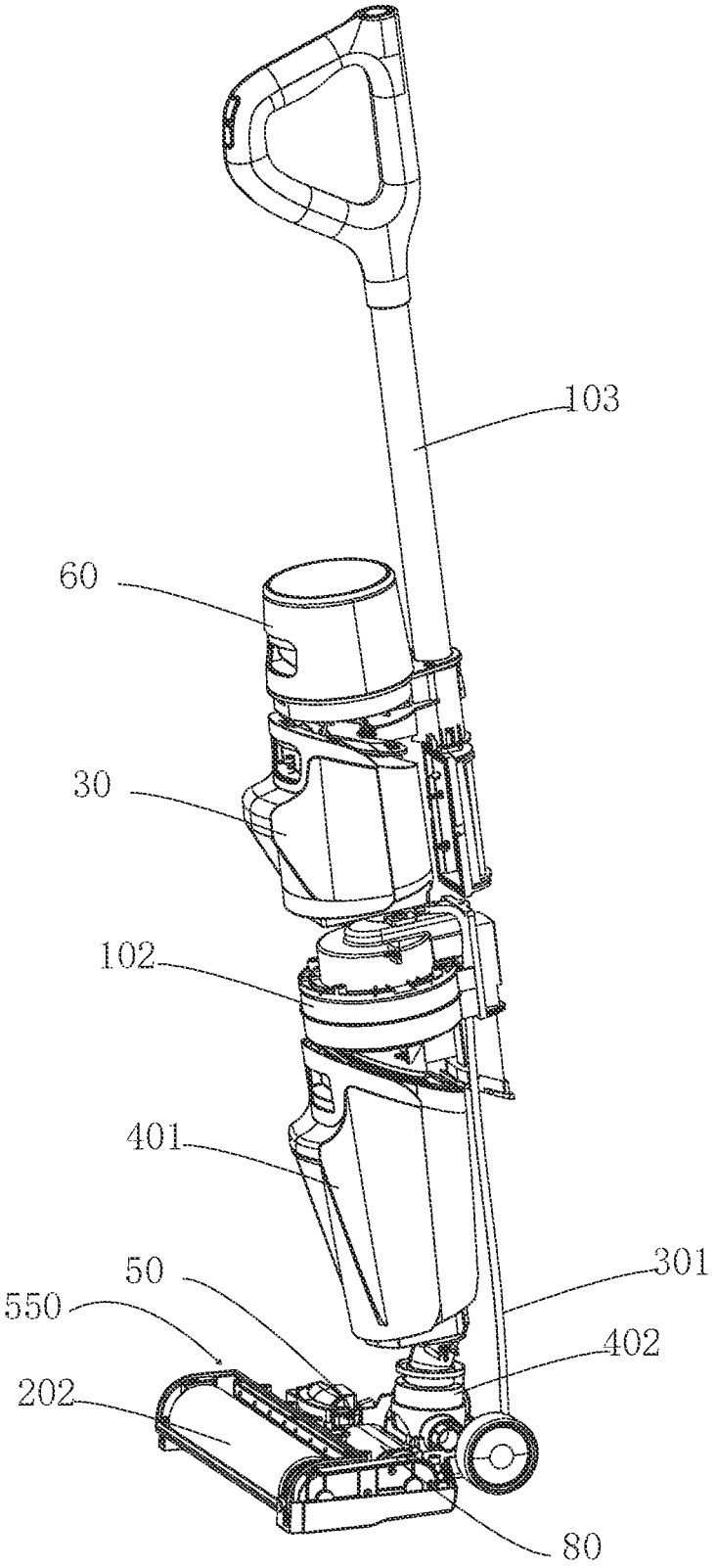
FIG. 1 is a schematic diagram of the internal structure of the cleaning device of the present invention after the housing and the fixed shell are removed.
Figure 2:
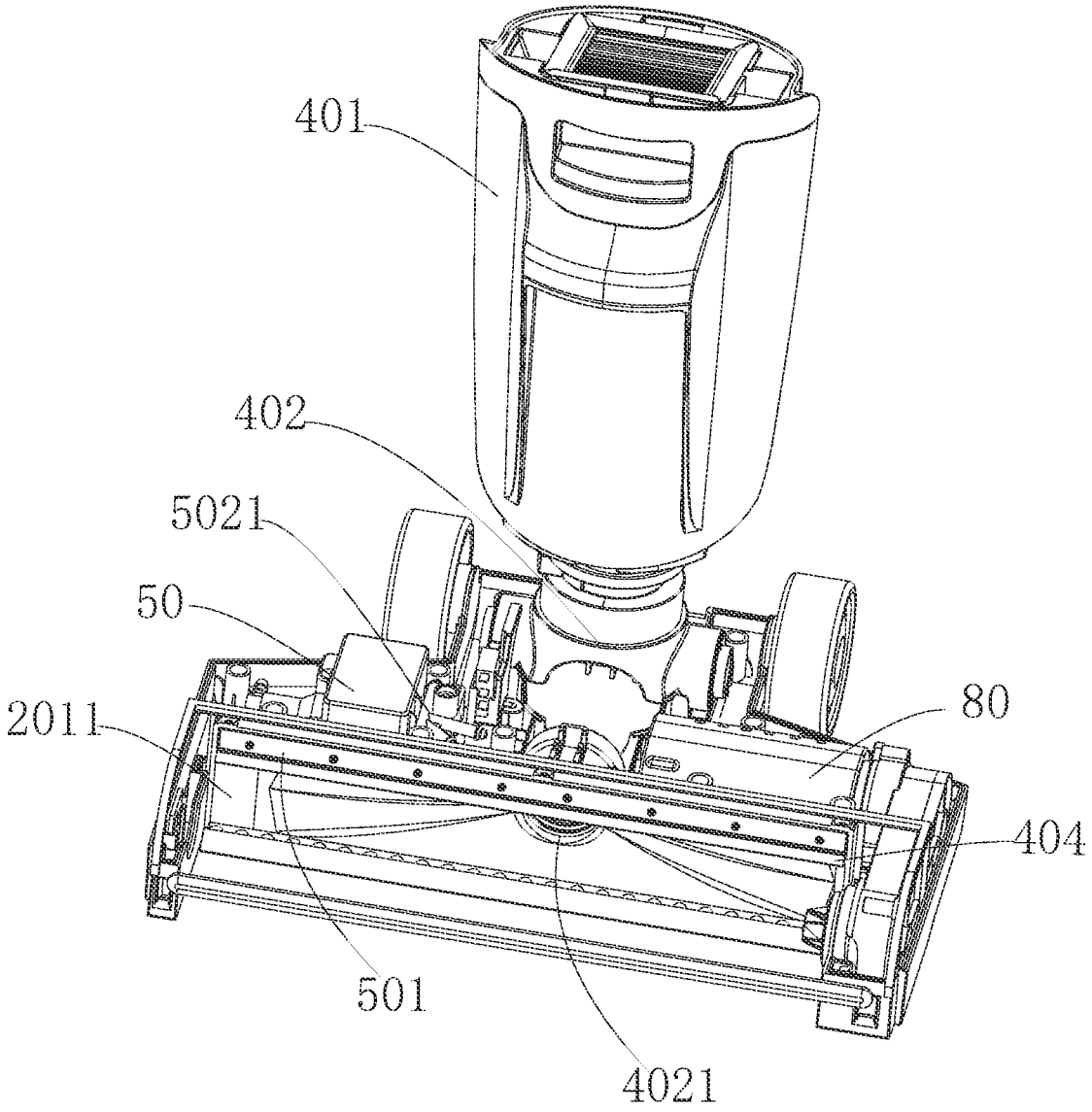
FIG. 2 is a partial structural diagram of the sewage recovery device and drag head assembly in the present invention.
Figure 3:
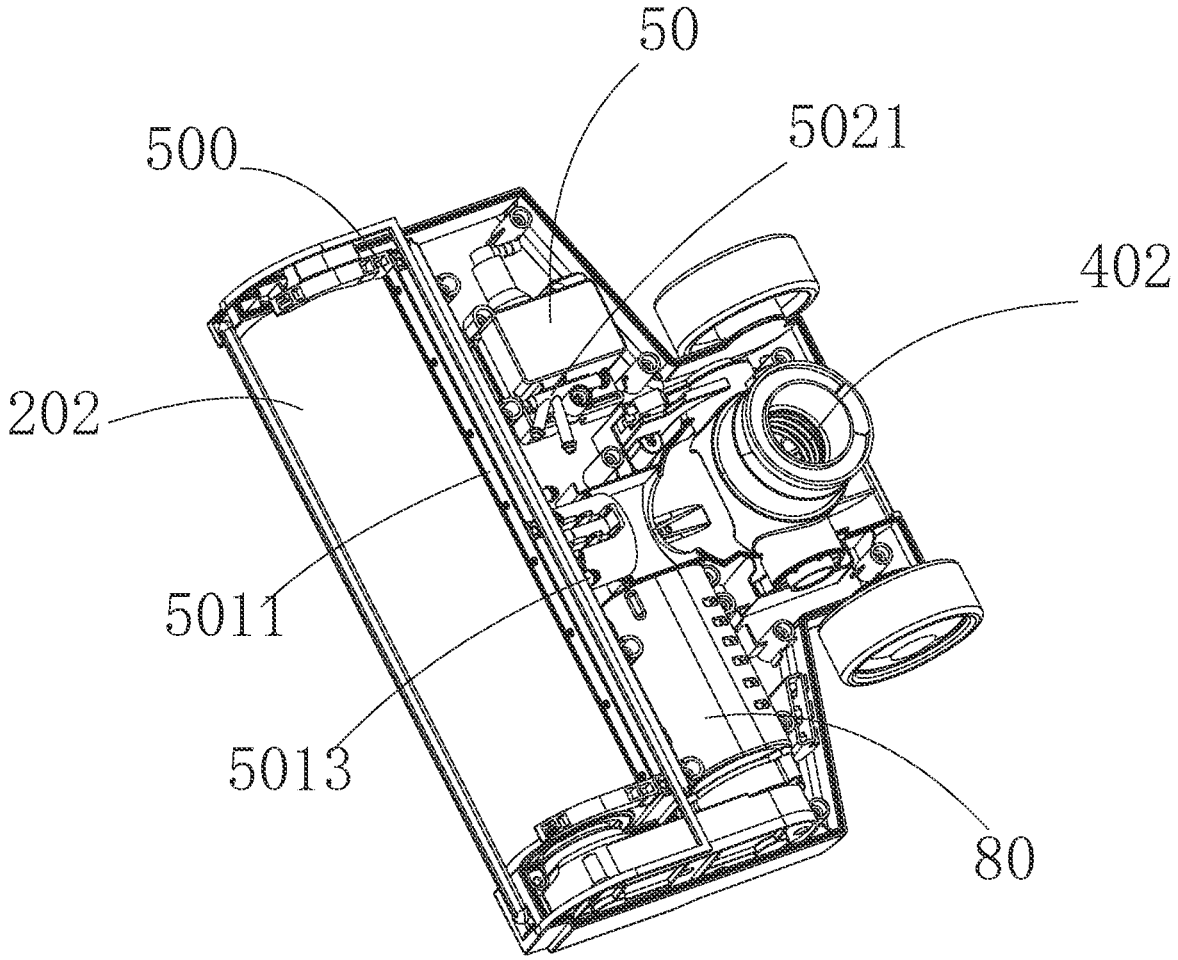
FIG. 3 is a diagram of the internal structure of the drag head assembly of the present invention.
Figure 4:
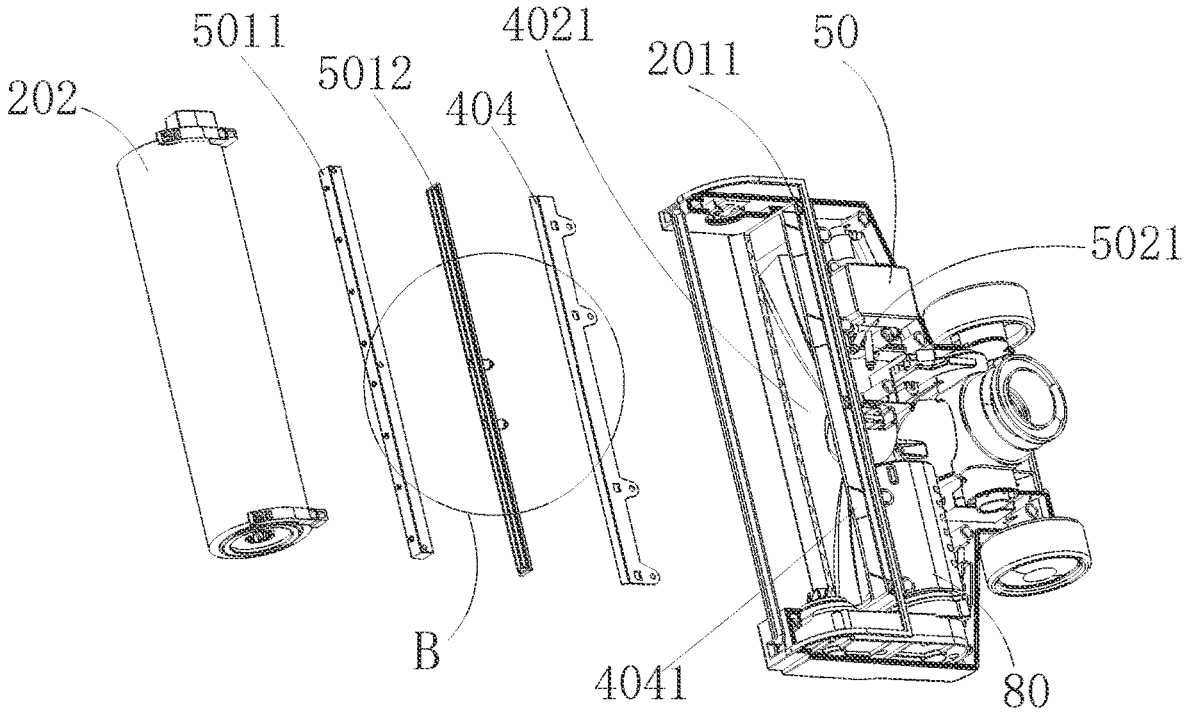
FIG. 4 is an exploded schematic view of the drag head assembly and water spray assembly of the present invention.
Figure 5:
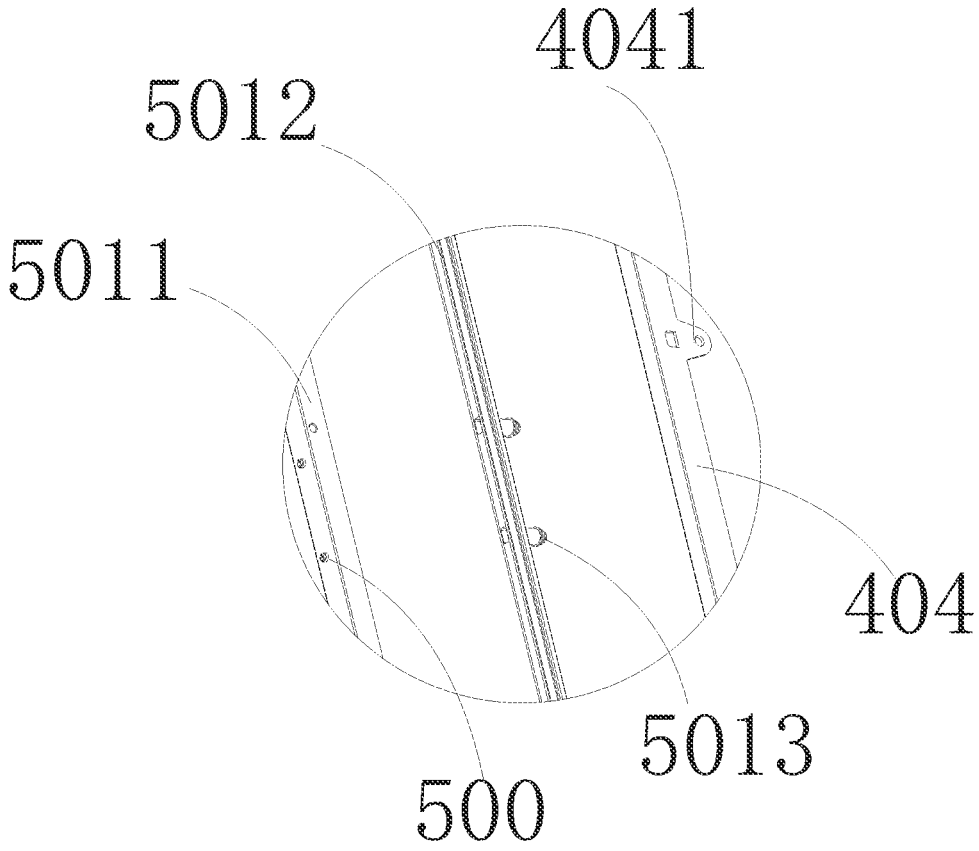
FIG. 5 is an enlarged view of Part B of FIG. 4.

The following will clearly and completely describe the technical solutions in the preferred embodiment of the present invention with reference to the drawings in the preferred embodiment of the present invention. Obviously, the described preferred embodiment is only a part of the embodiments of the present application, rather than all of the embodiments. Based on the preferred embodiment in the application, all other embodiments obtained by those of ordinary skill in the art without creative work, all belong to the scope of protection of the application.

As shown in FIGS. 1 to 14, the present preferred embodiment provides a cleaning device, comprising: a host 10, a drag head assembly 20, and a water spray assembly 550. The host 10 comprises a housing 101, a control device 102 housed in the housing 101, and a handle member 103 fixedly connected to the housing 101. The housing 101 contains at least one water inlet pipe 301 for connecting to a water source. The drag head assembly 20 is fixed on the housing 101 and electrically connected to the control device 102. The control device 102 is used to control the drag head assembly 20 for cleaning operations. The drag head assembly 20 comprises a fixed shell 201 and a cleaning brush head 202 fixed in the fixed shell 201. The water spray assembly 550 is fixed in the fixed shell 201 and communicates with the end of the water inlet pipe 301 away from the water source. The water spray assembly 550 comprises a number of evenly distributed spray holes 500, and the water outlet directions of the plurality of spray holes 500 are all facing the cleaning brush head 202.

As shown in FIGS. 1 to 6, preferably, the water spray assembly 550 comprises a nozzle portion 501 provided with a cavity 510, a diversion portion 502 fixedly connected to the nozzle portion 501 and in communication with the cavity 510. The spray holes 500 are provided on the side of the nozzle portion 501 facing the cleaning brush head 202. The diversion portion 502 communicates with the end of the water inlet pipe 301 away from the water source. The diversion portion 502 diverts the water in the water source to the cavity 510 through the water inlet pipe 301 and sprays it out through the spray holes 500.

As shown in FIGS. 1-7, preferably, the nozzle portion 501 includes a first nozzle portion 5011 and a second nozzle portion 5012 that are fixedly connected, and optionally, the first nozzle portion 5011 and the second nozzle portion 5012 are fixed to each other by tenon. The spray holes 500 are set on the side of the first nozzle portion 5011 facing the cleaning brush head 202. At least one deflector 5013 is provided on the side of the second nozzle portion 5012 opposite to the spray holes 500, and the deflector 5013 is fixedly connected to the diversion portion 502 and communicates with each other.

Figure 7:
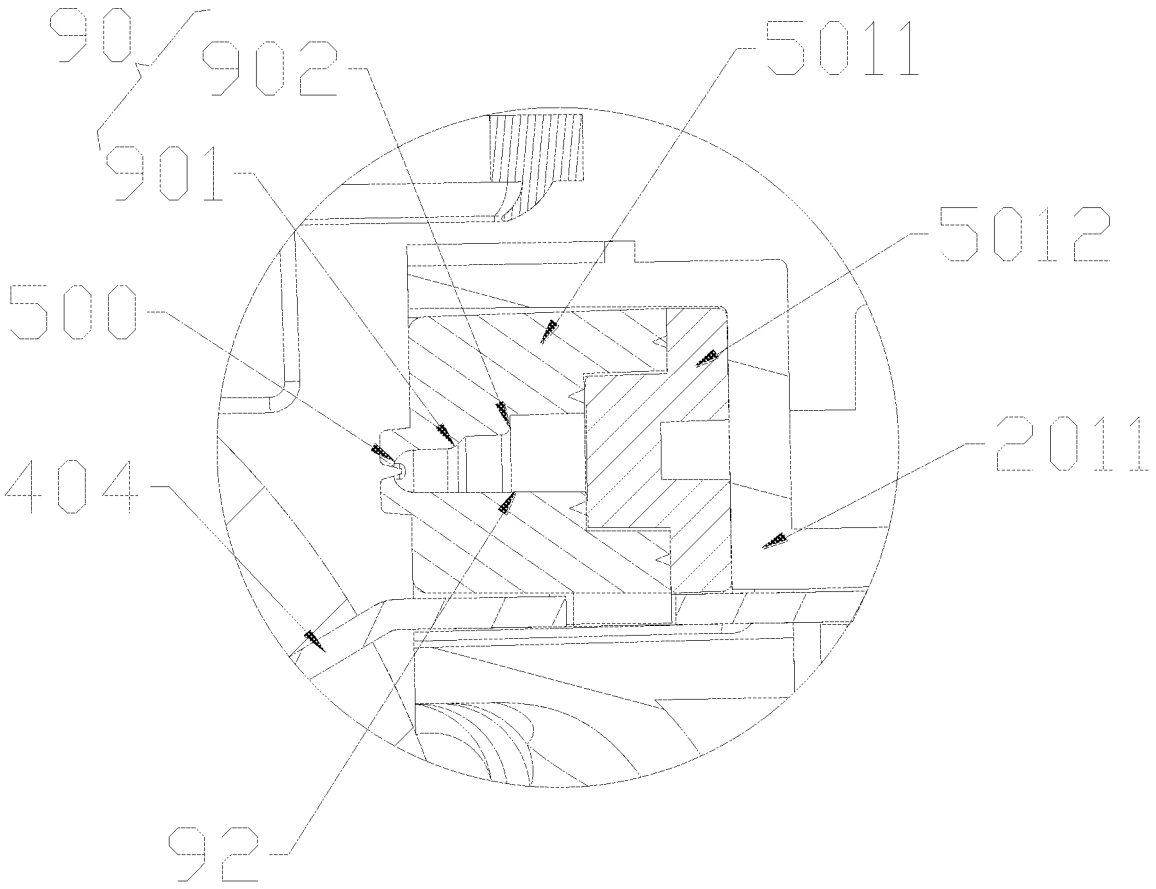
FIG. 7 is an enlarged view of Part C of FIG. 6.
Figure 8:
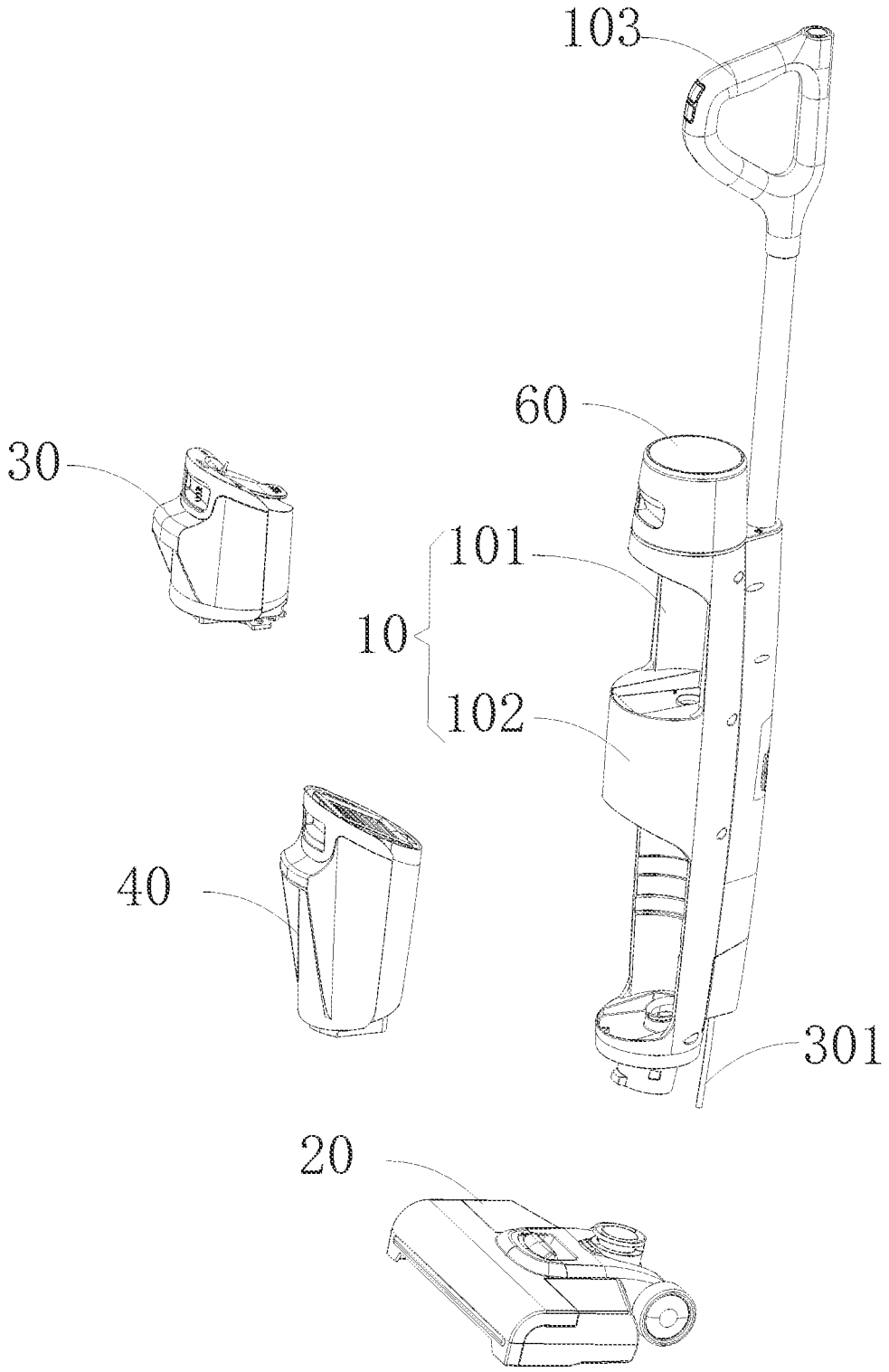
FIG. 8 is a partially exploded view of one embodiment of the cleaning device of the present invention.
Figure 9:
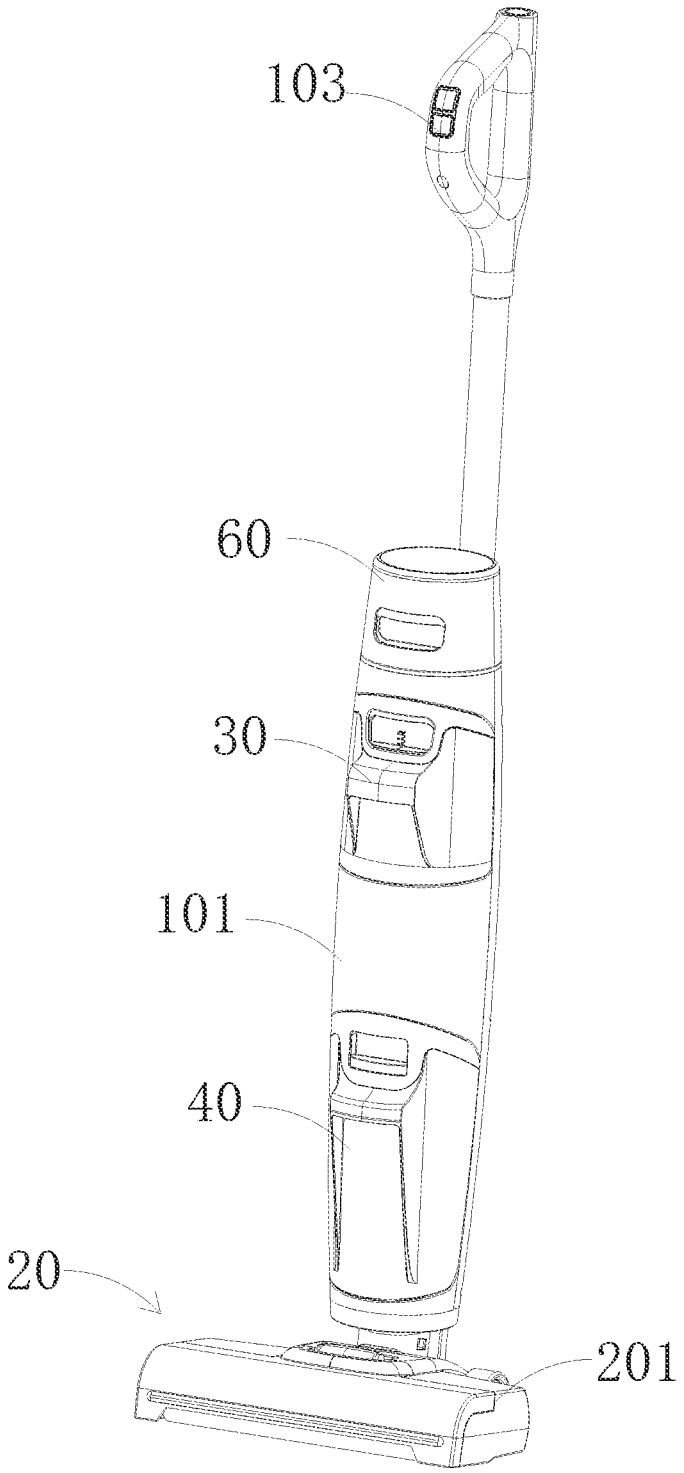
FIG. 9 is an elevational view of one embodiment of the cleaning device of the present invention.
Figure 10:
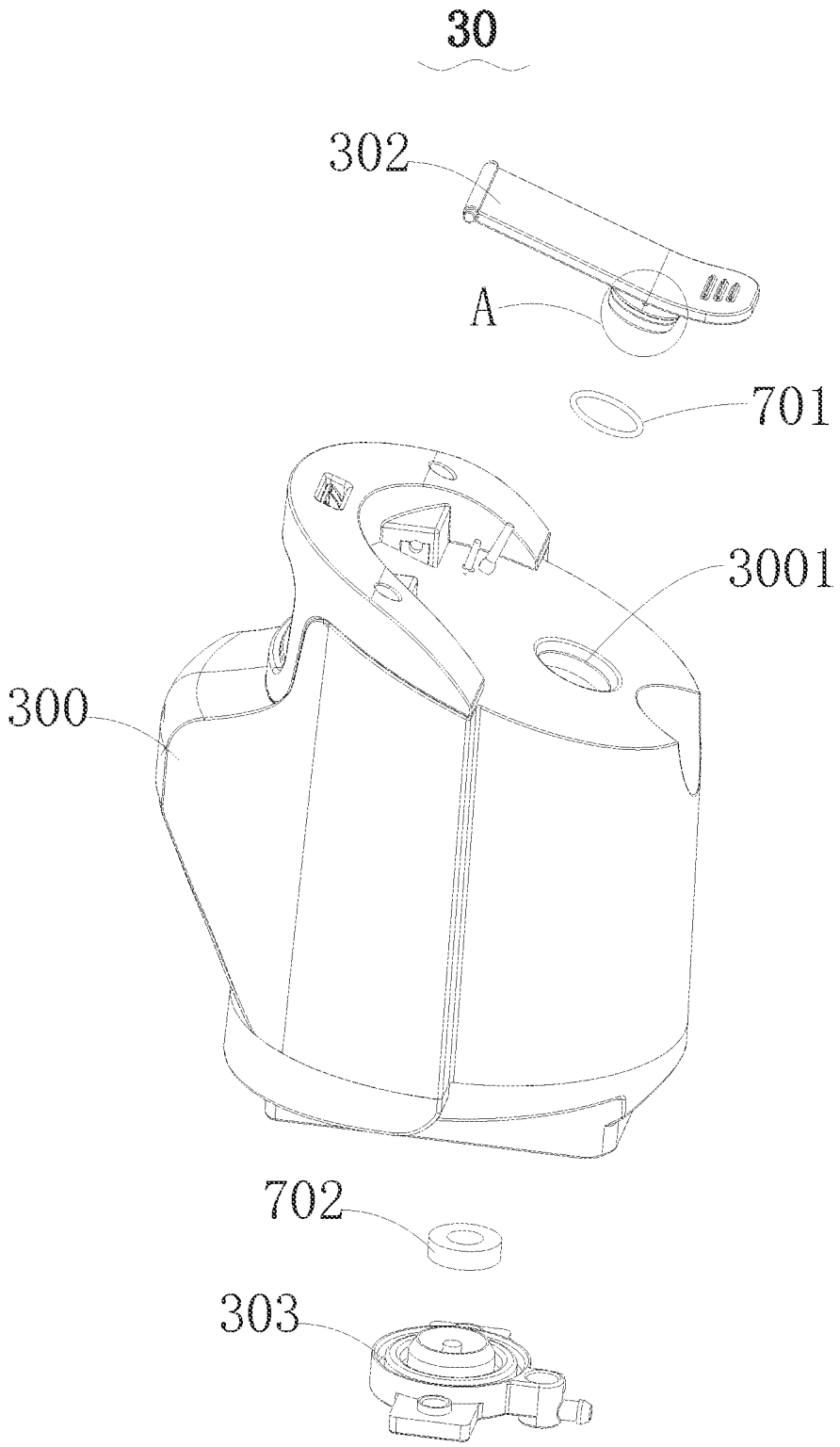
FIG. 10 is an exploded schematic view of the water tank device of the present invention.
Figure 11:
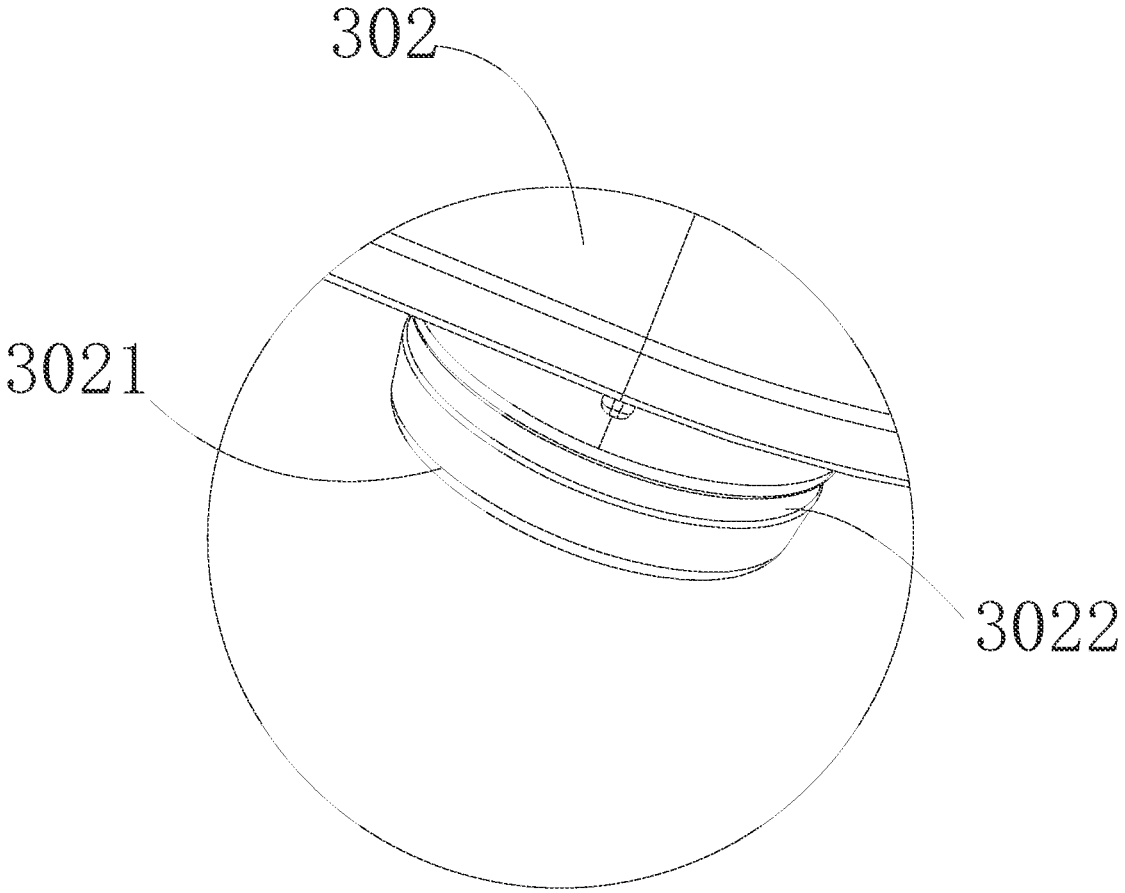
FIG. 11 is an enlarged view of Part A of FIG. 10.
Figure 12:
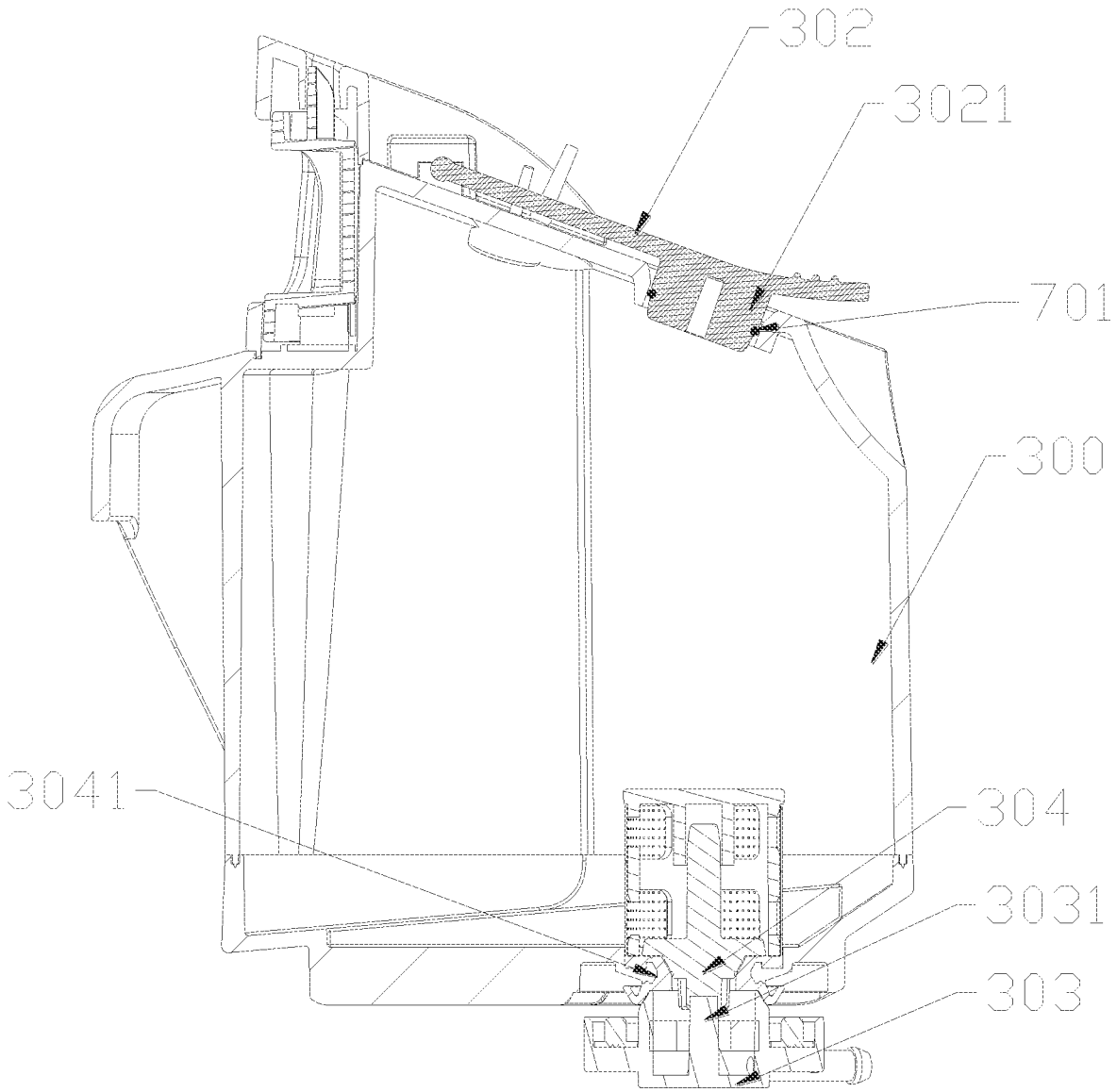
FIG. 12 is a cross-sectional view of the water tank device of the present invention cut along one of the planes.
Figure 13:
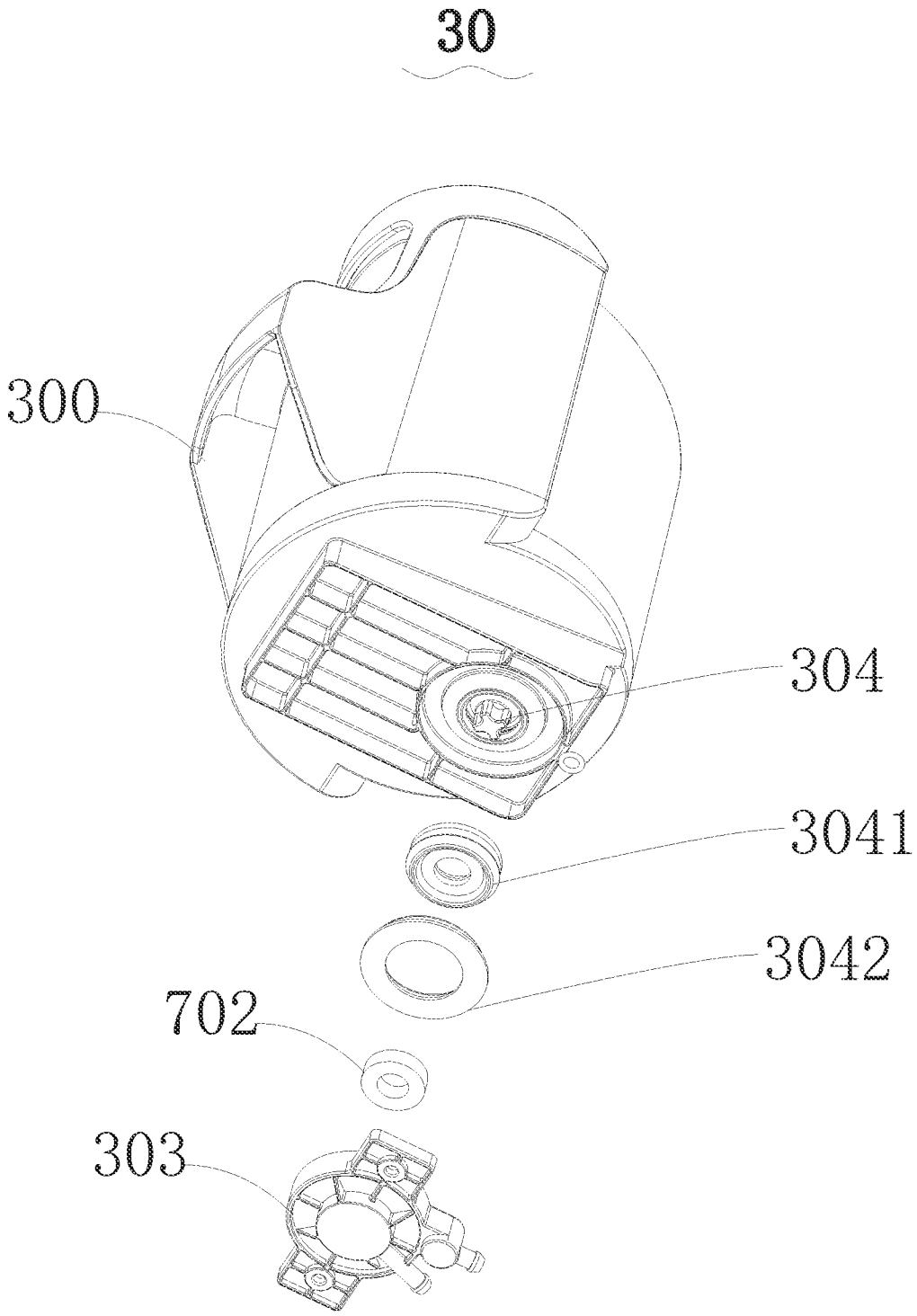
FIG. 13 is an exploded schematic view of the water tank device of the present invention.

As shown in FIG. 7, preferably, the inner diameter of the cavity 510 gradually increases along the spray holes 500 toward the second nozzle portion 5012.

Figure 6:
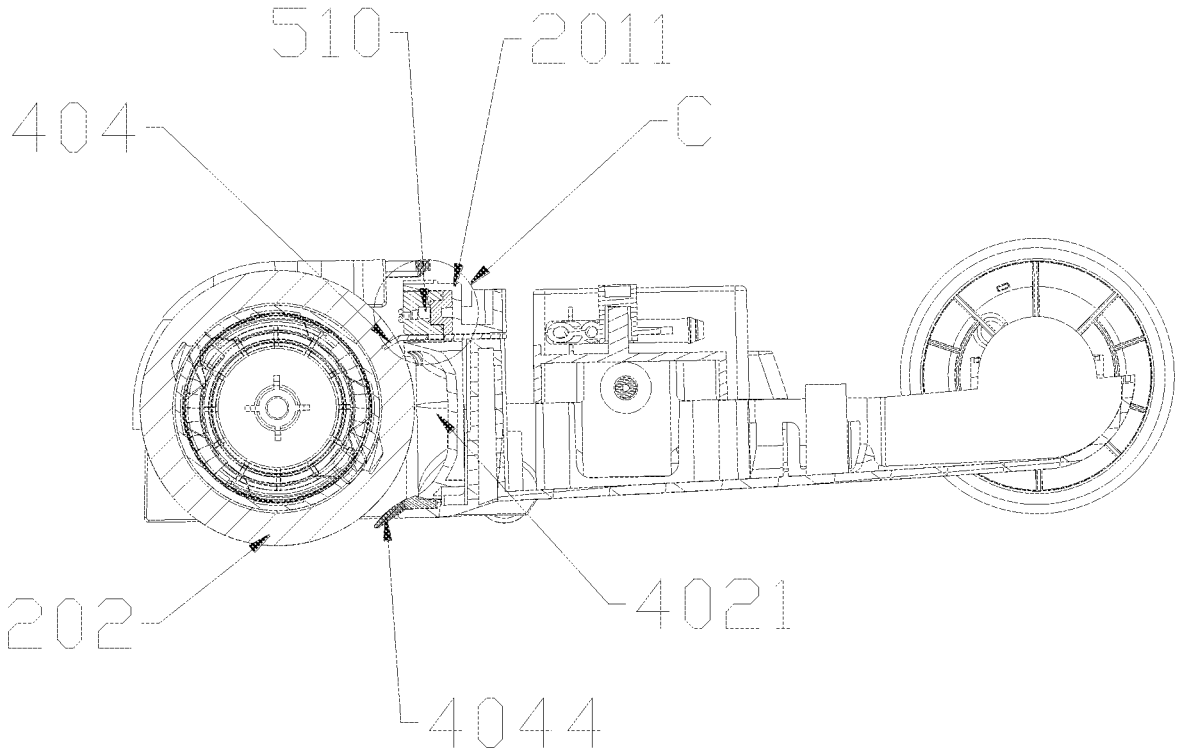
FIG. 6 is a schematic view of the present invention cut along the plane of the center of one of the spray holes.

Referring to FIGS. 6-7, preferably, the first nozzle portion 5011 has a first inner side wall 90 and a second inner side wall 92 that are arranged oppositely. On the first inner side wall 90, a first step 901 and a second step 902 are sequentially arranged along the spray holes 500 toward the second nozzle portion 5012. The distance between the first step 901 and the second inner side wall 92 is smaller than the distance between the second step 902 and the second inner side wall 92. It can be seen from the above setting of the cavity 510 that from the second nozzle portion 5012 to the first nozzle portion 5011 to the spray holes 500, the space in the cavity 510 gradually shrinks. When water flows into the cavity 510 from the deflector 5013, it will be filled with the semi-sealed cavity 510, and follow the direction of the water flow from the larger cavity 510 to the smaller cavity 510, and spray out from the spray holes 500 under the action of water pressure. This cavity 510 design not only increases the pressure of the water jet from the spray holes 500, but also enables the water flowing from the deflector 5013 into the cavity 510 to evenly fill the entire cavity 510 and then spray through each spray hole 500, further increasing the uniformity of spray water of the nozzle portion 501.

Referring to FIGS. 2-14, optionally, in an embodiment of the present invention, two deflectors 5013 are provided, which are correspondingly sleeved on two guide tubes 5022 connected by two interfaces of a three-way valve 5021. There are 8 spray holes 500 on the first nozzle portion 5011, and the 8 spray holes 500 are arranged at even intervals along the long side of the first nozzle portion 5011, that is, along the length of the cleaning brush head 202. It is worth noting that this setting is only an explanation of the embodiment of the present invention, and is not a limitation of the protection scope of the present invention.

Referring to FIGS. 2-14, preferably, the diversion portion 502 includes a water pump 50 connected to one end of the water inlet pipe 301 away from the water source, a three-way valve 5021 connected to the other end of the water pump 50, and a guide tube 5022 connected to the other end of the three-way valve 5021. The other end of the guide tube 5022 connected to the three-way valve 5021 is connected and fixed with the deflector 5013 to connect the three-way valve 5021 to the cavity 510. The water inlet pipe 301 includes a first water inlet pipe 3011 arranged between the water source and the water pump 50 and a second water inlet pipe 3012 arranged between the water pump 50 and the three-way valve 5021.

Referring to FIGS. 1-14, preferably, the water source is set as a water tank device 30 that is embedded in the housing 101 and has a water storage function. The water tank device 30 is connected to the first water inlet pipe 3011. The water tank device 30 includes a water tank 300 with water storage space that can be removed from the housing 101.

Referring to FIGS. 1-14, preferably, a sewage recovery device 40 is also provided. The sewage recovery device 40 includes a sewage tank 401 embedded in the housing 101, a suction assembly 402 connected to the sewage tank 401 and arranged in the drag head assembly 20, and a sewage pipe 403 for connecting the sewage tank 401 and the suction assembly 402. The suction assembly 402 sucks the sewage generated in the drag head assembly 20 away from the drag head assembly 20 and transports it to the sewage tank 401 through the sewage pipe 403.

Referring to FIGS. 1-14, optionally, housing 101 is equipped with an installation groove that matches the shape of the water tank 300 and the sewage tank 401. The present invention is also equipped with an independent battery assembly 60. The battery assembly 60 is fixed on top of housing 101. The water tank 300 is fixed on the upper part of housing 101 and under battery assembly 60. The sewage tank 401 is fixed at the lower part of housing 101 near the drag head assembly 20. Both the water tank 300 and the sewage tank 401 can be easily removed from the housing 101. The top of the water tank 300 is provided with a water tank cover plate 302 for sealing. The water tank cover plate 302 is rotatably arranged on the top of the water tank 300, and the top of the water tank 300 is provided with a water inlet 3001. The water tank cover plate 302 is provided with a cover plate flange 3021. The cover plate flange 3021 is provided with an annular first sealing groove 3022, matching the annular first sealing groove is provided with a first sealing ring 701, and the first sealing ring 701 is embedded in the first sealing groove 3022. When sealing the water tank 300, press and fix the water tank cover plate 302 in a manner that the cover plate flange 3021 is aligned with the water inlet 3001, and the first sealing ring 701 will seal the water inlet 3001 and further fix the water tank cover plate 302 in time. There is a drainage member 303 at the bottom of the water tank 300. One end of the water inlet pipe 301 is connected to the drainage member 303, and the other end is connected to the drag head assembly 20. The bottom of the water tank 300 is provided with a one-way valve 304 for sealing. The outer edge of the one-way valve 304 is sleeved with a fan-shaped sealing ring 3041. The fan-shaped sealing ring 3041 further ensures the sealing between the one-way valve 304 and the water tank 300 and prevents the liquid in the water tank 300 from leaking. A third sealing ring 3042 is also fixed outside the fan-shaped sealing ring 3041 to further fix and seal the water tank 300. The drainage member 303 comprises a drainage protrusion 3031 matching the one-way valve 304 and a second sealing ring 702 sleeved outside the drainage protrusion 3031. When assembling, make the second sealing ring 702 set outside the drainage protrusion 3031, and insert the drainage protrusion 3031 into the one-way valve 304. The drainage protrusion 3031 will open the one-way valve 304, and make the liquid in the water tank 300 flow into the water inlet pipe 301 connected to the drainage member 303 through the water inlet pipe 301. When the water in the water tank 300 is used up, the water tank 300 can be directly removed from the housing 101, and the water tank cover plate 302 can be opened to add water or cleaning fluid. After the water is added, install the water tank 300 on the housing 101 to continue the cleaning operation. Optionally, the capacity of the water tank 300 can be set with different parameters according to different application scenarios. The cleaning device equipped with a large-capacity water tank 300 can also be equipped with multiple spare water tanks 300, so that when the water tank 300 is disassembled and it takes too long to add water, it can be seamlessly connected without interrupting the cleaning operation.

Referring to FIGS. 2-7, preferably, the sewage recovery device 40 further comprises a scraper 404, the cleaning brush head 202 is set as a roller brush, the roller brush is rotatably set on the fixed shell 201, and the scraper 404 is fixed in the fixed shell 201 and contact with the roller brush. The fixed shell 201 comprises a fixed plate 2011. The water spray assembly 550 is fixed on the upper part of the fixed plate 2011. The scraper 404 is fixed on the fixed plate 2011 and is located below the water spray assembly 550. The suction assembly 402 comprises a suction port 4021, and the suction port 4021 is opened on the fixed plate 2011 and located below the scraper 404. The roller brush is assembled and fixed on the side of the fixed plate 2011 where the scraper 404 is installed and abuts against the scraper 404. Optionally, the scraper 404 is made of hard materials, such as metal. A soft rubber baffle 4044 is set under the scraper 404 and along the suction port 4021 away from the edge of the scraper 404.

Figure 14:
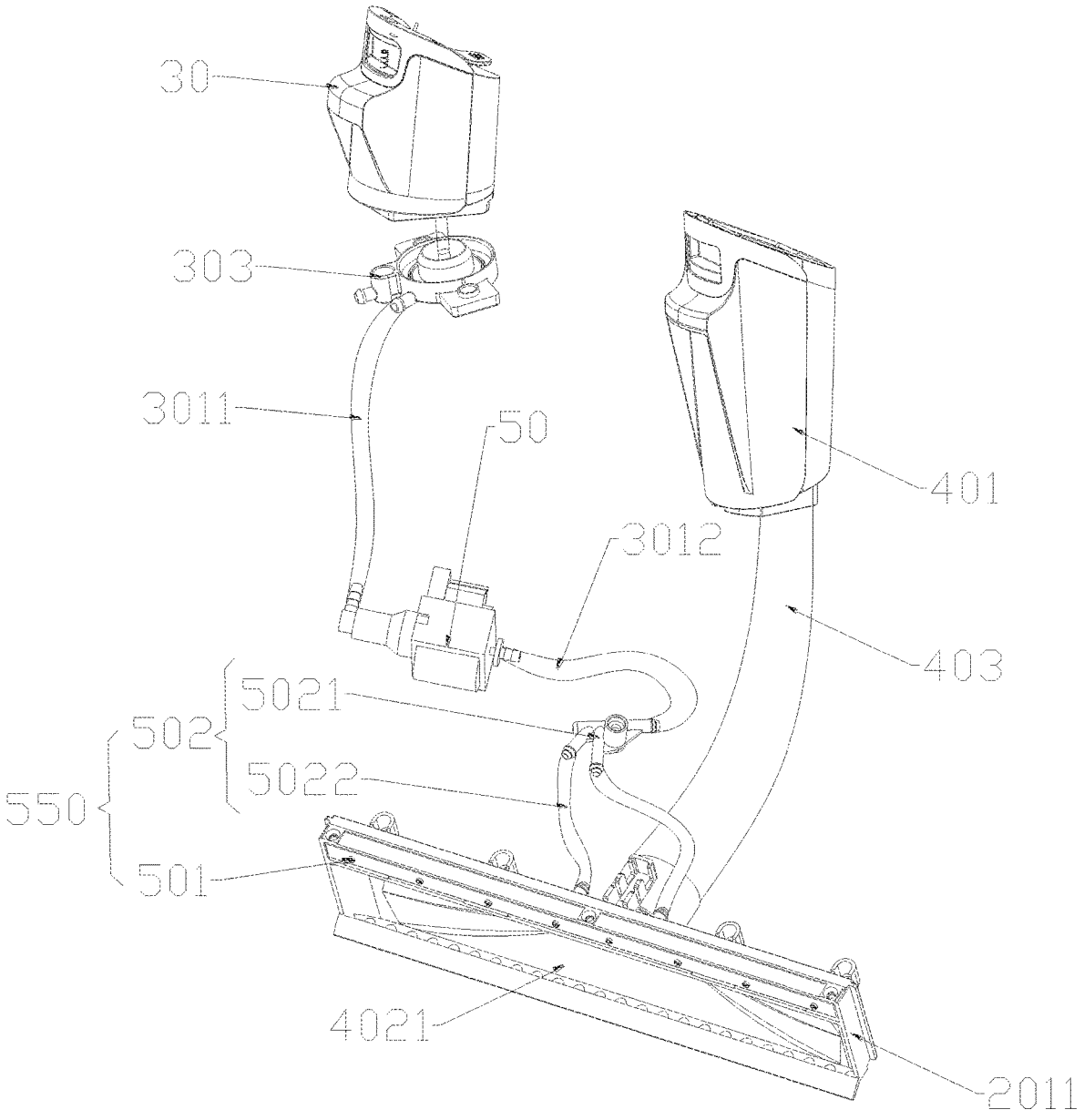
FIG. 14 is a schematic diagram of the connection of the waterway system of the present invention.

Referring to FIG. 14, after the water pump 50 is started, the clean water is drawn from the water tank 300 into the water spray assembly 550, and sprayed evenly to the cleaning brush head 202 through the spray holes 500. The roller brush is powered by a roller brush motor 80 set in the fixed shell 201. When the cleaning device is started for cleaning, the roller brush motor 80 drives the roller brush to rotate, and the clean water sprayed from the nozzle portion 501 can evenly cover the roller brush. The roller brush produces rolling friction or level friction with the surface to be cleaned (the user manually drags the roller brush horizontally), so that the stains on the surface to be cleaned in contact with the roller brush are attached to the roller brush and follow the rotation of the roller brush, causing it to interact with the roller brush. The scraper 404 abutted by the brush scrapes off the dirt sources (hair, paper scraps, etc.) and sewage on the roller brush. At this time, the suction assembly 402 started with the cleaning device sucks the above-mentioned dirt sources and sewage into the sewage pipe 403 through the suction port 4021, and transfers the dirt sources and sewage from the sewage pipe 403 to the sewage tank 401. At this point, the whole process of the entire waterway system work is completed, and the cleaning device provided by the present invention realizes a complete operation process from clean water supply and water cleaning to sewage recovery.

Referring to FIGS. 2-7, preferably, the fixed plate 2011 is installed in the fixed shell 201, and the water spray assembly 550 is fixed on the upper part of the fixed plate 2011. Optionally, the fixed plate 2011 is provided with a groove adapted to the water spray assembly 550 and a diversion hole provided on the groove corresponding to the deflector 5013. After the first nozzle portion 5011 and the second nozzle portion 5012 are mortise fit, the deflector 5013 is inserted into the above-mentioned groove by inserting into the diversion hole, and the first nozzle portion 5011 and the second nozzle portion 5012 are further fixed on the fixed plate 2011 by screws. The deflector 5013 extends out of the diversion hole and is fixed to the guide tube 5022 on the side of the fixed plate 2011 away from the nozzle portion. The fixed plate 2011 is provided with a scraper fixing groove 4042, and the scraper 404 is provided with a scraper fixing tooth 4041 that is compatible with the scraper fixing groove 4042. There is a screw hole on the scraper fixing tooth 4041. Insert the scraper fixing tooth into the scraper fixing groove 4042 and fix the scraper 404 with screws, and at the same time make the scraper 404 under the water spray assembly 550. The suction assembly 402 comprises the suction port 4021, which is opened on the fixed plate 2011 and located under the scraper 404. The roller brush is assembled and fixed on the side of the fixed plate 2011 where the scraper 404 is installed and abuts against the scraper 404.

In summary, the present invention solves the problem of wetting of the cleaning brush head 202 during the cleaning process by setting the water spray assembly 550 in the cleaning device and spraying water to the cleaning brush head 202. The evenly arranged spray holes 500 ensure that the surface of the cleaning brush head 202 can be wetted more evenly, which is beneficial to improve the cleaning effect of the cleaning device and improve the cleaning efficiency. In addition, the cleaning device is also equipped with a water tank device 30 that can independently store water, so that the cleaning device can independently supply water during the cleaning operation, which solves the problem of inconvenient water supply for the cleaning device during the cleaning process. The cleaning device is further equipped with a sewage recovery device 40, so that the sewage generated during the cleaning process can be recycled by itself, and the cleaning brush head 202 can be continuously cleaned, which is conducive to maintaining the cleaning effect of the cleaning brush head 202. In addition, it forms an independent waterway system through the water tank device 30, the sewage recovery device 40 and the water spray assembly 550, so that the cleaning device provided by the present invention can be used independently and is suitable for most places, which greatly reduces the workload of people's related labor, and is convenient to use, intelligent in operation, and suitable for most people.

Finally, it should be noted that the above preferred embodiment is only used to illustrate the technical solution of the application, rather than limiting it. Although the application has been described in detail with reference to the foregoing preferred embodiment, those of ordinary skill in the art should understand: it can still modify the technical solutions recorded in the foregoing preferred embodiment, or equivalently replace some of the technical features; and these modifications or replacements do not drive the essence of the corresponding technical solutions to deviate from the spirit and scope of the technical solutions of the embodiments of the present application.

What is claimed is:

1. A cleaning device, comprising:

a host, said host comprising a housing, a water source, a control device housed in said housing and a handle member fixedly connected to said housing, said housing containing a water inlet pipe means for connecting to said water source;

a drag head assembly fixed on said housing, said drag head assembly being electrically connected to said control device and controllable by said control device for cleaning operations, said drag head assembly comprising a cleaning brush head; and a water spray assembly fixed in said drag head assembly and communicating with one end of said water inlet pipe means away from said water source, said water spray assembly comprising a plurality of spray holes evenly distributed, the water outlet direction of said spray holes being all towards said cleaning brush head;

wherein said water spray assembly comprises a nozzle portion means provided with a cavity and a diversion portion fixedly connected to said nozzle portion means and in communication with said cavity, said diversion portion communicating with the end of said water inlet pipe means far away from said water source, said diversion portion diverting the water in said water source into said cavity through said water inlet pipe means and spraying the water out through said spray holes; said spray holes are set on one side of said nozzle portion means facing said cleaning brush head;

wherein said nozzle portion means comprises a first nozzle portion and a second nozzle portion fixedly connected to each other; said spray holes are arranged on one side of said first nozzle portion facing said cleaning brush head, said second nozzle portion being provided with at least one deflector on one side thereof opposite to said spray holes, said at least one deflector and said diversion portion being fixedly connected and communicated with each other.

2. The cleaning device as claimed in claim 1, wherein said cavity has an inner diameter thereof gradually increasing along said spray holes toward said second nozzle portion.

3. The cleaning device as claimed in claim 1, wherein said first nozzle portion comprises a first inner side wall and a second inner side wall set relative to each other, said first inner side wall comprising a first step and a second step sequentially arranged along said spray holes toward said second nozzle portion, the distance between said first step and said second inner side wall being less than the distance between said second step and said second inner side wall.

4. The cleaning device as claimed in claim 1, wherein said diversion portion comprises a water pump connected with one end thereof to the end of said water inlet pipe means away from said water source, a three-way valve connected with one end thereof to an opposite end of said water pump, and a guide tube connected with one end thereof to an opposite end of said three-way valve, said guide tube having an opposite end thereof connected and fixed to said at least one deflector to keep said three-way valve in communication with said cavity; said water inlet pipe means comprises a first water inlet pipe arranged between said water source and said water pump and a second water inlet pipe arranged between said water pump and said three-way valve.

5. The cleaning device as claimed in claim 4, wherein said water source is set as a water tank device that is embedded in said housing and has a water storage function, and said water tank device is in communication with said first water inlet pipe.

6. The cleaning device as claimed in claim 1, further comprising a sewage recovery device, said sewage recovery device comprises a sewage tank embedded in said housing, a suction assembly connected to said sewage tank and set in said drag head assembly, and a sewage pipe used to connect said sewage tank and said suction assembly; said suction assembly sucks the sewage generated in said drag head assembly away from said drag head assembly and transports the sewage to said sewage tank through said sewage pipe.

7. The cleaning device as claimed in claim 6, wherein said cleaning brush head is set as a roller brush, and said roller brush is rotatably set on said drag head assembly; said sewage recovery device also comprises a scraper, said scraper being fixed on said drag head assembly and kept in contact with said roller brush.

8. The cleaning device as claimed in claim 7, wherein said drag head assembly is provided with a fixed plate; said water spray assembly is fixed on an upper part of said fixed plate; said scraper is fixed on said fixed plate and located under said water spray assembly; said suction assembly comprises a suction port opened on said fixed plate and located below said scraper; said roller brush is assembled and fixed on the side of said fixed plate where said scraper is installed and abuts against said scraper.

* * * * *